United States Patent [19]

Anthony

[11] 4,357,176

[45] Nov. 2, 1982

[54] SYSTEM FOR CONSERVING ENERGY AND WASHING AGENTS IN A DISHWASHER

[76] Inventor: John A. Anthony, 2914 Eastchester Rd., Bronx, N.Y. 10469

[21] Appl. No.: 236,982

[22] Filed: Feb. 23, 1981

[51] Int. Cl.[3] ..... B08B 7/04

[52] U.S. Cl. ..... 134/18; 134/25.2; 134/46; 134/47; 134/48; 134/49; 134/113

[58] Field of Search ..... 134/18, 25.2, 46, 47, 134/48, 49, 113

[56] References Cited

U.S. PATENT DOCUMENTS

| | | | |
|---|---|---|---|
| 1,512,918 | 10/1924 | Forsgard | 134/46 |
| 3,221,754 | 12/1965 | Robson et al. | 134/113 X |
| 3,247,858 | 4/1966 | Kraeft | 134/46 |
| 3,339,564 | 9/1967 | Kraeft | 134/46 X |
| 3,706,317 | 12/1972 | Fox et al. | 134/46 X |
| 3,768,493 | 10/1973 | Kraeft | 134/46 |
| 3,800,813 | 4/1974 | Noren | 134/46 |
| 4,224,530 | 9/1980 | Simcoe et al. | 134/113 X |
| 4,228,813 | 10/1980 | Noren | 134/47 |

*Primary Examiner*—Marc L. Caroff

*Attorney, Agent, or Firm*—Parmelee, Bollinger & Bramblett

[57] ABSTRACT

In an electrically energized commercial dishwasher machine having at least one washing section followed by a rinse section and having a conveyor for conveying dishes through the various sections in sequence, a timing element is set to cause the machine to automatically shut off after running for a predetermined time period slightly longer than the time required for the conveyor to convey dishes through all the various sections of the machine. The timing element is reset to cause the machine to continue to run for a new such predetermined time period whenever a signal from a sensor indicates the presence of dishes in the rinse section.

7 Claims, 4 Drawing Figures

START
RUN
CONVEYOR
TIMING CONTROL
TIMING ON
TIMING OFF
RINSE IS OPERATING
CONVEYOR HAS STOPPED
CONVEYOR IS RUNNING
WASHER WILL SOON STOP RUNNING (LOAD IT SOON)
WASHER IS RUNNING
CLOCK
MANUAL
KEY SWITCH
CONSERVATION
CONVEYOR MOTOR
RELAY FOR MOTOR
RINSE SOLENOID VALVE
RINSE SENSOR SWITCH
SENSOR
3φ ~

SYSTEM FOR CONSERVING ENERGY AND WASHING AGENTS IN A DISHWASHER

FIELD OF THE INVENTION

This invention is in the field of commercial dishwasher machines as used in restaurants, hotels, motels, hospitals and other establishments or institutions in which large numbers of dishes, cups, saucers, platters, bowls, knives, forks, spoons, etc. are washed repeatedly. Such dishwasher machines are of two types: (1) rack type, (2) continuous conveyor belt type as will be described more fully further below. This invention relates to method and system for conserving energy, water and washing compounds in commercial dishwasher machines of either type and of any large commercial size.

BACKGROUND OF THE INVENTION

In most restaurants, hotels, motels, hospitals and other establishments or institutions in which large numbers of dishes, etc. and eating utensils are repeatedly washed in large commercial dishwasher machines, the electricity and hot water being consumed by the dishwasher machine are not metered to the machine itself. The dishwasher personnel who are working in the kitchen are usually very busy handling the dishes, etc. and the utensils for three meals a day. These personnel do not pay much attention to the dishwasher machine itself so long as it is operating satisfactorily. They do not wish to be bothered with turning the dishwasher machine on-and-off during a working day. In many instances, in my personal observation, the dishwasher personnel will turn on the dishwasher machine at the beginning of a working day, and then they turn the machine off at the end of the working day. The management of the institution is usually not aware of the consumption of electricity and hot water occurring in the dishwasher machine itself, because these are not separately metered to the dishwasher machine. In fact, the electricity and hot water for the kitchen may not be separately metered from the institution as a whole. Thus, it is difficult for management effectively to determine whether or not excessive amounts of electric energy, hot water and washing compound are being consumed by the dishwasher machine. In a test which I carried out in a restaurant, the consumption of washing compound was actually reduced to approximately one-third during one entire week by employing the present invention. The electricity and hot water to the machine involved were not metered, but the conclusion seems logical that the consumption of electricity and hot water were also reduced approximately to one-third. Also, it is logical to conclude that the wear and tear on the dishwasher machine were reduced to approximately one-third. It is my estimate that today in New York City a large dishwasher machine running continuously each day that the restaurant is open for business and in which the hot water in the power wash and power rinse stations is electrically heated and the hot water in the final rinse station is electrically boosted in temperature to more than 180° F. will consume $10,000 to $20,000 of electrical power in one year, and possibly even more.

SUMMARY OF THE INVENTION

The problems of excessive consumption of electricity, hot water and washing compound are advantageously overcome by the method and system of the present invention.

Advantageously, the machine is automatically shut off whenever a sensor in the final rinse station of the dishwasher signals that the rinse station is empty. An adjustable time delay is associated with this final rinse station sensor and it can be set to a predetermined time delay as may be desired, depending upon the throughput time of the machine for assuring that the machine has completely emptied itself of dishes and implements before the automatic shut off occurs.

A key-actuated switch in this system enables the machine to be returned to its normal manual control mode at any time desired by the management, for example when maintenance is to be performed on the system or in the event of malfunction of the energy conserving system. Therefore, the management is assured that the dishwasher machine itself is never rendered non-useable by this energy conserving system, since the dishwasher machine can be immediately returned to its manual control mode by flipping a key actuated switch at any time.

In accordance with another feature of this invention the conventional "STOP" switch of the dishwasher machine is not over-ridden by this energy conserving system. Thus, the machine can be stopped immediately whenever the "STOP" switch is actuated.

It is an object of the present invention to conserve electrical energy, hot water, and dishwashing compound in commercial dishwasher machines of the rack type and of the continuous conveyor belt type. A rack type dishwasher machine is one in which the dishes and implements are loaded into portable racks. These racks are pushed through the dishwasher machine by a reciprocating conveyor bar having a plurality of ratchet fingers (often called "feed dogs") which project up to engage the bottom of the racks during the forward stroke of the conveyor bar for pushing the racks forward in the machine a predetermined distance equal to the forward stroke of the conveyor bar. During the return stroke of the conveyor bar these feed dogs retract and slide back beneath the racks without moving the racks backward.

A continuous conveyor belt type of dishwasher machine has a conveyor made of pivotally interconnected links in the manner of a wide chain belt, with spaced upwardly projecting elements for supporting dishes in upstanding position, i.e. resting on one edge between the elements, for augmenting drain-off of the dishes during washing in the machine. This conveyor belt moves forward continuously through the machine.

As used in the specification and claims, the term "dishes" is used generically to include dishes, cups, saucers, platters, plates, bowls, glasses, mugs, pitchers, trays, and the like. The term "implements" is used generically in the specification and claims to include knives, forks, spoons, spreaders, ladles, and the like.

As used in the specification and claims, the term "conveyor" is used generically to include a continuous motion conveyor and an intermittent motion conveyor and is used generically to include a conveyor having a belt as the conveying means and a conveyor having movable racks which are moved as the conveyor means.

As used herein the term "food service utensils" is used generically to include both "dishes" and "implements."

BRIEF DESCRIPTION OF THE DRAWINGS

The various features, aspects, objects and advantages of this invention will become more fully understood from a consideration of the following detailed description in conjunction with the accompanying drawings, in which.

DETAILED DESCRIPTION OF PREFERRED EMBODIMENT

Figure 1:
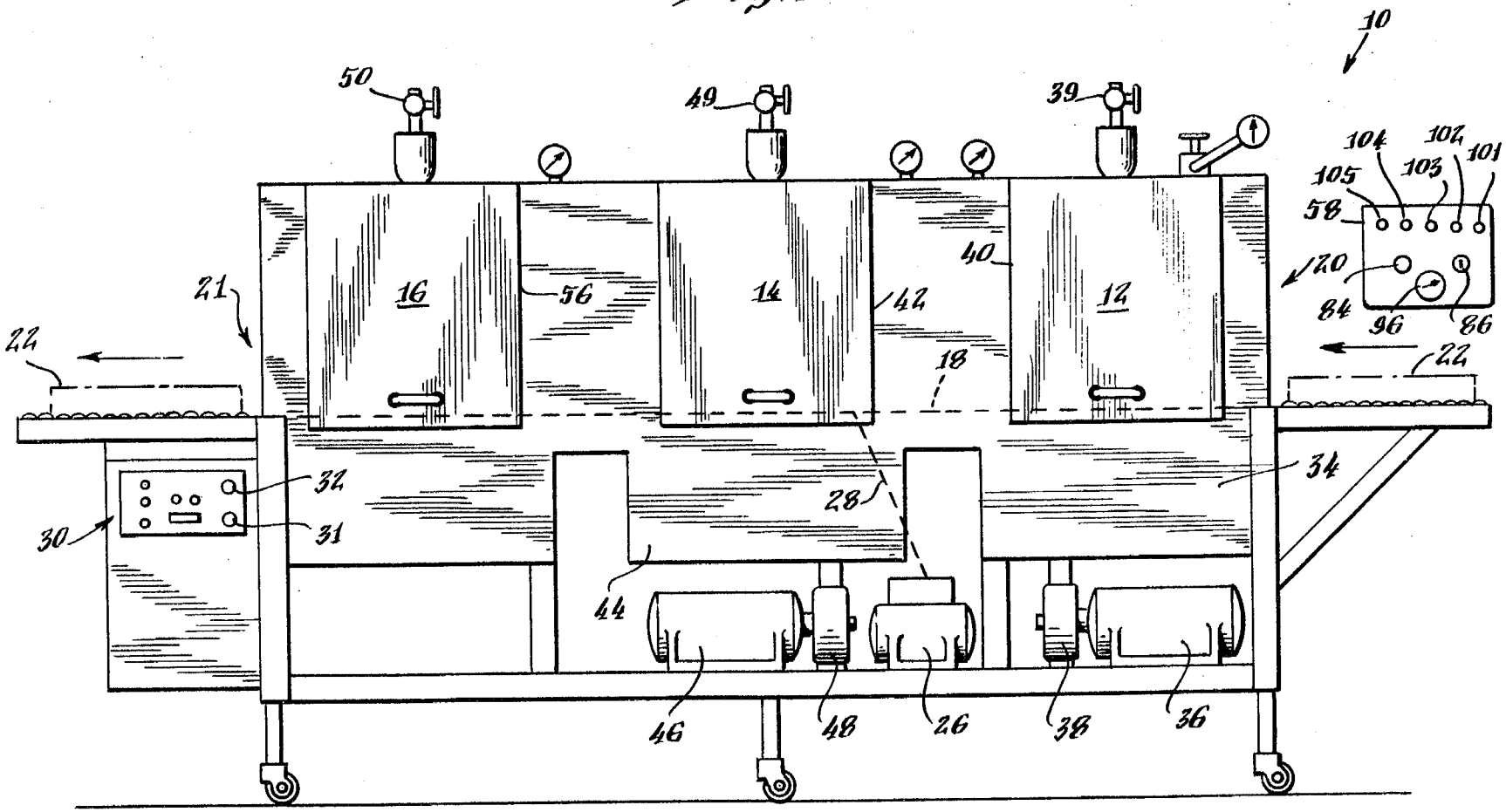
FIG. 1 is a side elevational view of a large commercial-type of dishwasher machine embodying the present invention.

Referring to FIG. 1, there is shown a commercial dishwasher machine 10 including three bays or sections, namely, a power driven pre-wash section 12, a power driven main wash section 14, and a hot rinse section 16. A conveyor 18 extends from an entrance end 20 of the machine through these three sections of the machine for conveying dishes and implements through these three sections in sequence for washing and rinsing them. Then the conveyor conveys the washed and rinsed dishes and implements out the exit end 21. This conveyor 18 may be a rack-type conveyor or a belt-type conveyor, depending upon whether the machine 10 is an intermittent motion rack-type of machine or a continuous motion belt type of machine.

As explained in the introduction, a rack type dishwasher machine is one in which the dishes and implements are loaded into portable racks. These racks are pushed through the dishwasher machine by a reciprocating conveyor bar having a plurality of ratchet fingers (often called "feed dogs") which project up to engage the bottom of the racks during the forward stroke of the conveyor bar for pushing the racks forward in the machine a predetermined distance equal to the forward stroke of the conveyor bar. During the return stroke of the conveyor bar these feed dogs retract and slide back beneath the racks without moving the racks backward. Also, as explained in the introduction, a continuous conveyor belt type of dishwasher machine has a conveyor made of pivotally interconnected links in the manner of a wide chain belt, with spaced upwardly projecting elements for supporting dishes in upstanding position, i.e. resting on one edge between the elements, for augmenting drain-off of the dishes during washing in the machine. Such a conveyor belt moves forward continuously through the machine.

The present invention is applicable to both types of commercial dishwasher machines; however, for purposes of illustration, it is assumed that this is a rack-type of machine, with the dishes and implements being loaded into manually portable racks 22 which are slid through the machine 10 on a pair of spaced tracks 24 (FIG. 3) by the conveyor 18. A conveyor drive motor 26, usually a three-phase alternating current (AC) induction motor, operates the conveyor 18 through an appropriate drive mechanism 28 as is known in the commercial dishwasher art. This conveyor drive mechanism 28 usually incorporates an overload-responsive friction-slip clutch which will slip whenever the conveyor 18 encounters an unduly large impedance against moving. The motor 26 is energized through a relay, and this relay is tripped open when the overload-responsive clutch begins to slip, as is known in the commercial dishwasher machine art.

The dishwasher machine 10 is equipped with a conventional control panel 30 including a start button 31 for normally starting operation of the machine and a stop button of a normally closed switch 32 which immediately stops operation of the machine whenever this stop button is depressed, regardless of the stage of operation of the machine at the instant when this stop button is actuated. It is among the advantages of the conservation method and system of this invention that they do not interfere with the operability of this stop button. Therefore, the machine 10 can be stopped immediately at any time by pressing the stop button 32.

The pre-wash section 12 includes a tank 34 at the bottom of this section for holding hot water containing a dishwashing compound. A motor 36 drives a pump 38 for recirculating this water from the tank 34 for washing the dishes and implements in this pre-wash section 12. There is an electrical heater incorporated in the machine for keeping the water hot in the tank 34. Whenever the machine 10 is running, hot water is continuously added to the tank 34.

As the water is added to the tank 34 through a solenoid valve 39, a washing compound is automatically metered into the incoming hot water by conventional metering equipment, as known in the art. The tank 34 has an overflow weir leading into a sewer line connection, so that the water level in this tank cannot exceed the overflow setting. This prewash section 12 usually includes a removable screen (not shown) located above the tank 34 for catching lumps of food material that have been washed from the dishes and implements. In order to provide access into the prewash section, there is a removable door 40.

From the above discussion, it will be understood that the motor 36 and pump 38 are running whenever the machine 10 is running. Moreover, hot water is continuously being added into the tank 34, together with a washing compound whenever the machine is running. Therefore, unnecessary operation of this machine inevitably involves the consumption of hot water, washing compound and energy for heating the incoming water to the desired relatively high temperature and for energizing the pump motor 38, plus the energy for energizing the conveyor motor 36. In some cases, sewerage charges are involved, depending upon the quantity of water being discharged into the sewer line.

Inviting attention to the main wash section 14, there is a similar tank 44 located at the bottom of this section for holding the hot wash water which also contains a washing compound. It is to be understood that the hot water in the tank 44 is kept separated from the water in the tank 34, and there are suitable internal baffles and curtains between the sections 12 and 14 for the purpose of isolating these two sections while permitting the conveyed racks containing dishes and implements to travel along the conveyor 18.

Whenever the machine 10 is running, hot water passing through a solenoid valve 49 is continuously added to this tank 44 into which washing compound is metered. The motor 46 and pump 48 serve to recirculate the hot water from the tank 44 for washing dishes and implements in section 14. A removable door 42 provides access into the main wash section 14.

Consequently, whenever the machine 10 is running, this section also consumes hot water, washing compound and electrical energy for heating the incoming water, and for energizing the pump motor 46.

In the rinse section 16, the hot water is not recirculated. It is electrically heated to assure that the rinse water has a temperature above a minimum of 180° F. A rinse compound is automatically metered into the incoming rinse water for causing the dishes and implements to dry sparkling clean without streaking.

A solenoid valve 50 allows the hot rinse water to be sprayed over the dishes and implements in the rinse section whenever this solenoid valve 50 is electrically energized.

Figure 3:
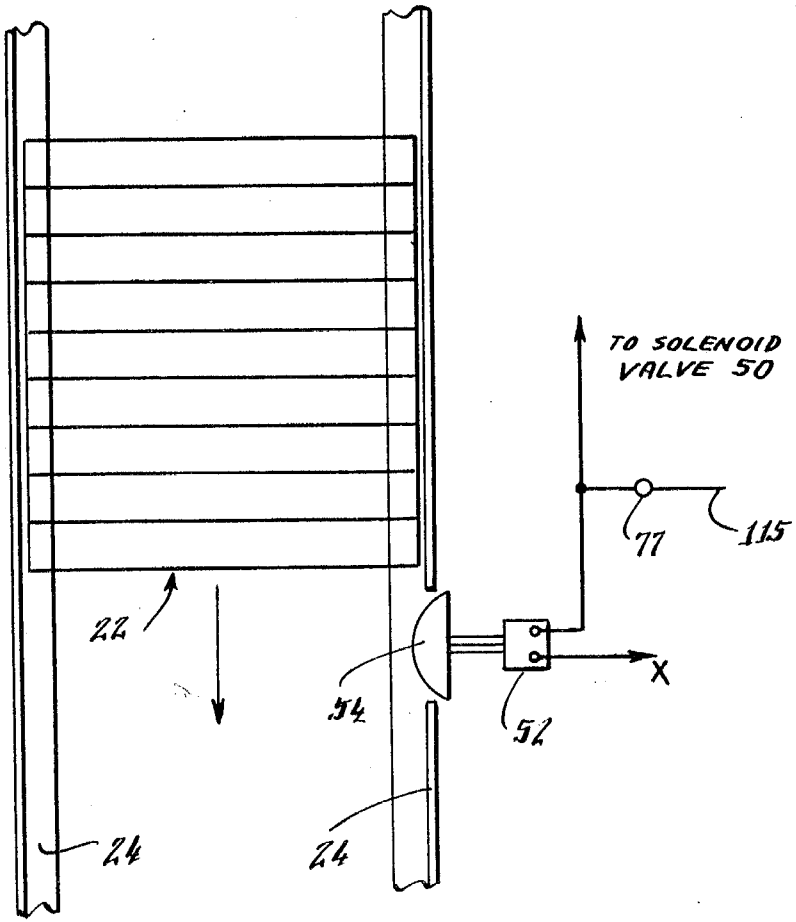
FIG. 3 is a plan view illustrating one type of sensor which may be employed in the rinse section of the dishwasher machine.

As shown in FIG. 3, there is a sensor switch 52 operated by a cam 54 which is actuated whenever a rack 22 is present in the rinse section. This sensor switch and cam 54 are conventionally included in the machine 10 for energizing the solenoid valve 50 whenever a rack 22 is resident in this rinse section 16. It is among the advantages of the invention that this method and system enable use of the existing sensor 54 and sensor-actuated switch 52 for conserving hot water, energy and washing compound.

Figure 2:
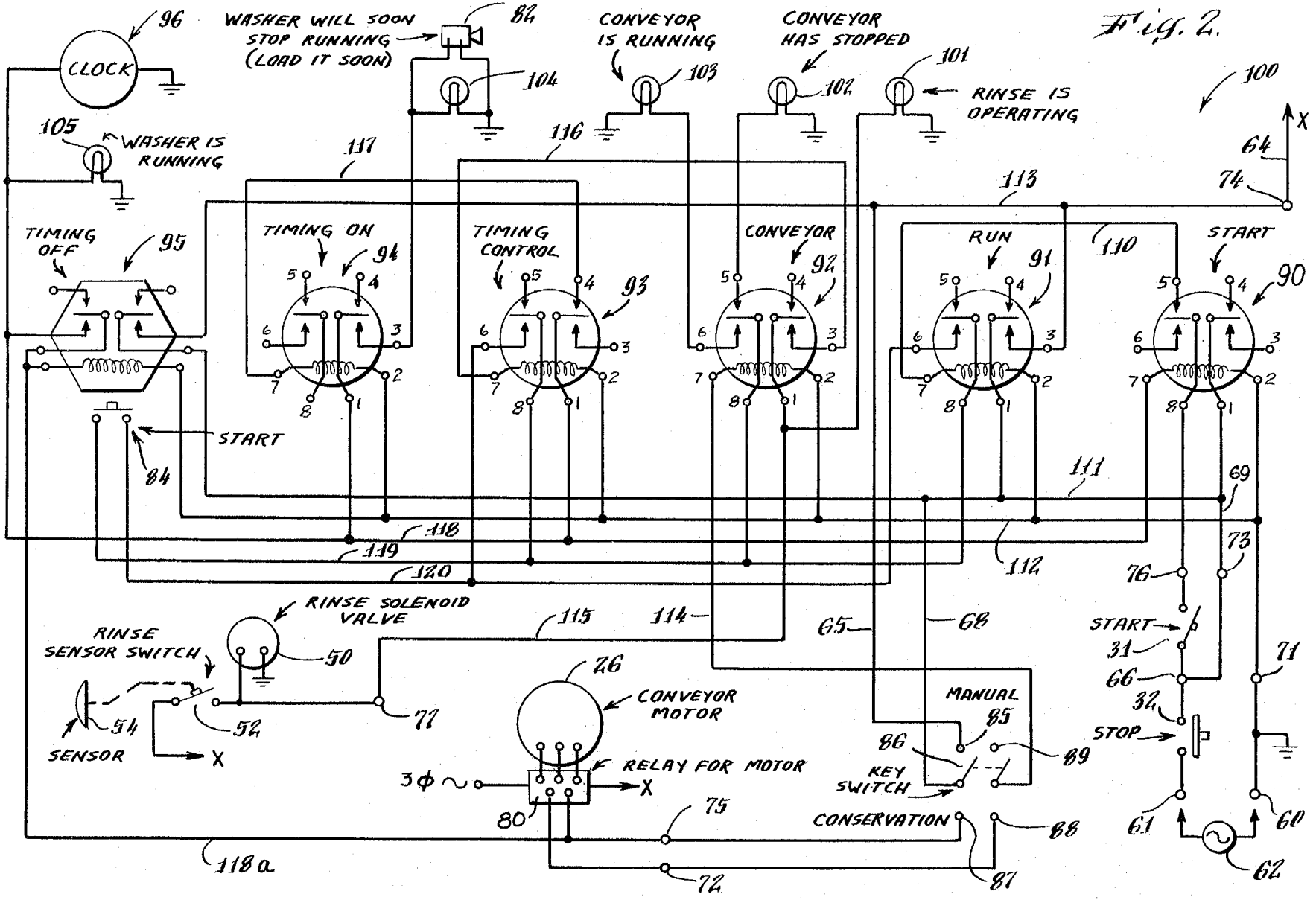
FIG. 2 is a schematic diagram of the control system employed in the machine shown in FIG. 1.

In FIG. 2 is shown a conservation control system 100 embodying this invention for saving hot water, washing compound and electrical energy in the operation of the dishwasher machine 10. This system is included in a cabinet 58 which may be mounted on the machine 10 or on a wall or building support column, or other permanent structure located conveniently near to the machine 10. In FIG. 1 the conservation control cabinet 58 is shown mounted on the wall near the entrance 20 of the washer machine 10.

The power supply terminals of the dishwasher machine are shown at 60 and 61 for connection to a suitable source 62 of electrical power, for example, a 60-cycle 120 volt AC outlet. The existing stop switch of the dishwasher 32 is located in the lead from the so-called "hot" terminal 61, the other terminal 60 being the neutral lead, as indicated by the "ground" symbol.

The conservation control system 100 includes seven terminals 71 through 77, respectively, for making external connections, as will be explained as this description proceeds. The terminal 71 is connected to the neutral (ground side) 60 of the electrical supply for the dishwasher machine 10.

The conservation control system 100 includes six relays 90, 91, 92, 93, 94 and 95, respectively, for providing various control functions, as will be explained. In addition, there is an elapsed time registering clock 96 which is turned "on" whenever the washer machine is running. This clock 96 tells the operator the cumulative length of time that the machine has been running. By periodically reading this clock, the management can determine the extent to which the dishwasher 10 has been running since the previous reading.

The relay 95 is a "TIMING OFF" relay which automatically turns "off" after a predetermined time period. At the time of installation of this system 100, the relay 95 is pre-set by the installer for a time period which is slightly longer than the length of time required for the conveyor 18 to convey a given food service utensil from the entrance 20 to the exit 21 of the machine 10. In other words, this relay 95 is pre-set for a time period slightly longer than that required for the machine to complete one full washing cycle. For example, this timing relay 95 may be pre-set for a time period approximately 5% longer than the time required for the machine 10 to complete one full cycle of washing operation.

Conventionally, a commercial dishwasher machine, such as the machine 10, has a conveyor 18 which advances the food service utensils through the machine at an average of approximately 3.5 to 4 feet per minute. Therefore, if the machine 10 is approximately ten feet long from entrance 20 to exit 21, a full washing cycle duration is approximately 2.5 to 2.9 minutes. In such a case, the timing off relay 95 would be pre-set for a time period from approximately 2.6 to 3.0 minutes, depending upon the particular full washing cycle duration of the specific machine involved. This timing relay is enclosed and arranged in the cabinet 58 so that it cannot be readjusted by the machine operator.

The relay 94 is also a timing relay, except that it is a "TIMING ON" relay which is arranged to turn "on" after a predetermined time period which is set by the installer. The time period for this relay 94 is somewhat shorter than the time period for relay 95. In other words, relay 94 will turn "on" a short time interval, for example, twenty seconds, before the relay 95 turns "off." The purpose of this timing on relay 94 is to alert the operator that the machine will soon automatically stop running. Therefore, the machine should be loaded quickly if there are further dishes and implements remaining to be washed. The terminal 3 of this relay 94 is connected to a horn 82 and a signal light 104 for providing a short "beep" tone as well as flashing the signal light, when the timing relay 94 turns "on."

In order to install this system 100 in the washer 10, the "hot" lead 64 of the dishwasher is disconnected from the terminal 66 of the stop switch 32. Instead, this hot lead 64 is connected to the terminal 74 of this conservation control system. This hot lead 64 of the dishwasher machine is indicated by "X" at several places in FIG. 2. Then, the terminal 73 of this system is connected to the terminal 66 of the stop switch 32.

Terminals 72 and 75 of the system 100 are connected into the power control relay 80 of the conveyor motor 26. As discussed above, the conveyor motor 26 is conventionally supplied with 3-phase AC electrical power through the relay 80. This relay contains three sets of contacts for controlling the electrical power to be supplied to the motor 26. There is a fourth set of contacts in this relay 80, and the terminals 72 and 75 are connected to this fourth set of contacts. Thus, a circuit is completed between terminals 72 and 75 whenever the conveyor motor is energized by actuation of the motor relay 80.

These terminals 72 and 75 are connected to the switch terminals 87 and 88 of a double-pole, double-throw key switch 86 which can only be operated by the proper key. When the switch arms are turned up to the contacts 85 and 89, the switch 86 is set for "MANUAL" operation. When the switch arms are turned down to the contacts 87 and 88, this switch is set for automatic "CONSERVATION" operation by employing the system 100.

The purpose of this key switch 86 is to enable the machine 10 to be returned to its customary manual control operation in the event that the control system 100 might malfunction. Consequently, the management of the installation where the washer machine 10 is located is assured that this system 100 will not cause any loss of operation, because the management can immediately turn the key switch if the operator reports any malfunction in this system 100. By tracing the circuit path 66-73-69-111-68-86-85-65-113-74-64 involving the switch contact 85 and its associated switch arm, the reader will see that when the key switch is set for MANUAL operation, the terminal 66 of the stop switch 32 is directly connected to the terminal 74 of the system and to the "hot" power lead 64 of the washer. Consequently, the system 100 is completely by-passed, and the washer 10 will run in its conventional manner.

The terminal 76 of this conserving system 100 is connected to the controlled side of the start switch 31 of the washer. Thus, terminal 8 of the start relay 90 is energized whenever the start switch on the machine is closed.

The terminal 77 of this system is connected to the controlled side of the rinse-sensor-actuated switch 52. Thus, the terminal 77 becomes energized whenever the rinse is operating, and a signal light 101 is turned "on" which indicated to the operator that the rinse section of the washer is operating. As shown in FIG. 1, this signal light 101, as well as the other signal lights 102, 103, 104 and 105 are located on the front panel of the cabinet 58. Energization of this terminal 77 also serves to energize the terminal 1 of the conveyor control relay 92.

The conservation control cabinet 58 conveniently includes a start switch 84 associated with the timing off relay 95 so that the operator can manually start the machine by pressing either the usual start switch 31 or this second start switch 84.

In operation when the start switch 31 is closed, a circuit is completed from the electrical supply terminal 61 to terminal 8 of the start relay 90, thereby feeding power to terminal 5 which is connected by a lead 110 to the terminal 7 of the "RUN" relay 91 for energizing the relay winding of which the other terminal 2 is connected to the neutral (ground) lead 112. Thus, energization of this RUN relay 91 causes its arms to engage contacts 6 and 3, thereby completing a circuit from the hot lead 111 through terminals 1 and 3 to the lead 113 which is connected with the machine supply terminal 74. Consequently, power is now supplied from terminal 73 through leads 69 and 111, and through the terminals 1 and 3 of the RUN relay 91 to the supply terminal 74 of the washer, thereby placing the washer in its normal running operation.

Since the dishwasher is now running, the relay 80 for the conveyor motor is closed, providing a connection between terminals 72 and 75. Consequently, electrical power is fed from the terminal 73 through the leads 69, 111, 68, key switch terminal 87, terminal 75, contacts in motor relay 80, terminal 72, key switch terminal 88 and lead 114 to terminl 7 of "CONVEYOR" relay 92. Thus, the winding of the CONVEYOR relay 92 is energized for closing a circuit to the relay terminal 6 to energize the signal lamp 103 for indicating to the operator that the conveyor is running.

If, for any reason, the conveyor motor relay 80 is deenergized, the winding of CONVEYOR relay 92 becomes deenergized, thereby turning off the signal lamp 103, while turning on the signal lamp 102 to indicate to the operator that the conveyor has become stopped, possibly as the result of a jammed rack 22.

Assuming that the dishwasher is running normally, a rack 22 will enter the rinse section 16, actuating the switch 52 for operating the rinse solenoid valve. Through terminal 77 and lead 115 the closure of switch 52 also energizes the terminal 1 of CONVEYOR relay 92. Since the conveyor is operating, the relay arm is making contact with the terminal 3 for closing a circuit through a lead 116 from this terminal 3 over to terminal 7 of the "TIMING CONTROL" relay 93. Consequently, the right hand relay arm of this TIMING CONTROL relay 93 is separated from its contact 4 and no electricity can flow through the lead 117 to terminal 7 of the TIMING ON relay 94. Therefore, whenever the rinse sensor switch 52 is closed the TIMING ON relay is deenergized to become returned to the beginning of its time measuring period.

Whenever the conveyor motor relay 80 is closed, the TIMING OFF relay begins its measuring period, because the conservation system terminal 75 is connected through a lead **118*a* to the winding of the relay 95 for energizing this relay winding whenever the conveyor motor begins running. Therefore, the washer will automatically be shut off by the TIMING OFF relay 95 at the end of its pre-set time limit, unless the rinse sensor switch 52** becomes actuated during the pre-set measured time period.

Whenever the rinse switch 52 causes the TIMING CONTROL relay 93 to deenergize the TIMING ON relay 94, it also completes a circuit from the lead 119 through relay terminals 8 and 6 of relay 93 to the lead 120. In other words, actuation of the TIMING CONTROL relay 93 serves to complete a circuit between the leads 119 and 120 which, in effect, is the same as occurs when the start switch 84 is closed.

Figure 4:
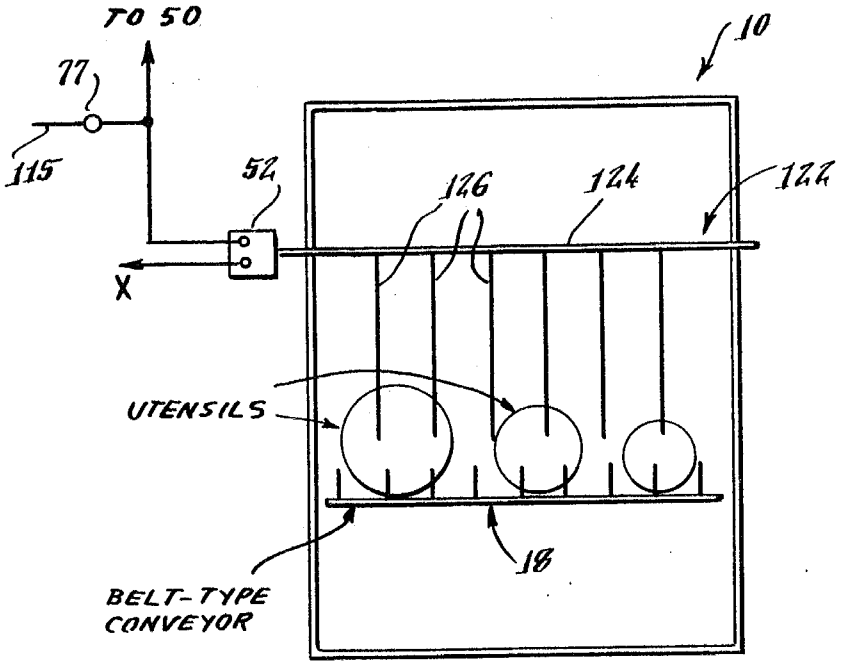
FIG. 4 is an elevational view of another type of sensor which may be employed in the rinse section of the dishwasher machine.

As shown in FIG. 4, in a washer machine in which the conveyor 18 is of the belt type, the rinse sensor switch 52 is controlled by a so-called whip-type of switch actuator 122. This whip-type actuator 122 includes a pivotally mounted horizontal rod which extends across the machine at a sufficiently high elevation that the rod 124 will clear all utensils conveyed by the conveyor 18.

There are multiple legs 126 secured to the rod 124 and extending down from this rod so that these legs are swung forwardly when food service utensils are conveyed beneath the actuator 122, thereby closing the switch 52 for energizing the rinse solenoid valve. Actuation of this switch 52 produces the other desirable conservation control action by the system 100 by virtue of connecting the system terminal 77 to the control side of this rinse switch 52 in FIG. 4.

It is to be understood that the pump motors 36 and 46 are three phase induction motors each of which has a control relay for energizing it whenever the washer machine 10 is running. The relays for these pump motors as well as the relay 80 for the conveyor motor 26 are customarily located in the control cabinet 30 of the washer 10. In order to employ the present invention it is not necessary to make any additional connections to these conventional pump motor relays, and so they are not shown in FIG. 2.

Thus, advantageously, the conservation control system 100 and the method automatically causes the washer machine 10 to run sufficiently long to complete a full cycle of washing whenever the rinse sensor switch 52 is actuated. However, if there are no dishes or implements within the washer, then the machine 10 is automatically turned off at the end of the pre-set time period as established by the TIMING OFF relay 95.

A suitable TIMING ON relay 94 is commercially available under the designation Cramer Solid State Timer, Model 390A, which can be pre-set at any point over a range from 3 to 300 seconds.

An appropriate TIMING OFF relay 95 can be obtained commercially from National Control Corporation of Lombard, Ill., having a range of adjustment from 1.8 to 180 seconds.

A practical CLOCK 96 is a running meter available from ENM Company, of Chicago, Ill.

From the foregoing description it will be appreciated that the particular machine 10 as shown and the sensor arrangements as shown in FIGS. 3 and 4 are illustrative and are provided by way of example and are not intended as limitations. Also, FIG. 2 shows the conservation system of the present invention as hard wired circuit. It will be understood by those skilled in the art that the various timing, signalling and control functions as described can be equivalently performed by a microprocessor. However, it is my preference to employ circuit components as shown because a very rugged system 100 is thereby obtained, in view of the fact that the ambient conditions around a commercial dishwasher machine are often humid and warm.

This invention is not limited to the examples shown but is intended to be interpreted and understood to the full scope of the following claims.

I claim:

1. The method of conserving energy, water and washing compound in a commercial, electrically energized dishwasher machine having one or more washing sections followed by a rinse section and having a conveyor for conveying dishes through the various sections in sequence from an entrance into the machine to an exit from the machine, comprising the steps of:

setting a predetermined time period slightly longer than the length of time required for the conveyor to convey a given food service utensil from the entrance through the respective sections of the machine to the exit of the machine, starting the measurement of such a time period whenever the machine is manually turned on, automatically shutting off the machine at the expiration of such a time period, and re-starting the measurement of a new such time period whenever the presence of a food service utensil is sensed in the rinse section of the machine thereby keeping the machine running until such new time period has elapsed for assuring that the machine will fully complete the washing and rinsing of any food service utensil in the machine while advantageously shutting off the machine soon after it has become empty.

2. The method of conserving energy, water and washing compound in a commercial, electrically energized dishwasher machine as claimed in claim 1, including the step of:

setting a second predetermined time period somewhat less than the first predetermined time period, starting the measurement of such second time period whenever said first time period is started, and providing a warning signal at the end of the second time period for alerting the operator of the washer machine that it will soon be automatically turned off, whereby the operator, if desired, can reload the machine before it is automatically shut off.

3. A system for conserving energy, water and washing compound in a commercial, electrically energized dishwasher machine having one or more washing sections followed by a rinse section and having a conveyor for conveying dishes through the various sections in sequence from an entrance into the machine to an exit from the machine, comprising:

pre-settable timing means for setting a predetermined time period slightly longer than the length of time required for the conveyor to convey a given food service utensil from the entrance through the respective sections of the machine to the exit of the machine, said timing means being connected to be responsive to a part of the dishwasher which is actuated whenever the dishwasher is turned on for starting the measurement of such a time period whenever the machine is manually turned on, said timing means being connected to the electrical energizing circuit for the machine for automatically shutting off the machine at the expiration of such a time period, and said timing means also being connected to a sensing means responsive to the presence of a food serving utensil within said rinse section of the machine for re-starting the measurement of a new such time period whenever the presence of a food service utensil is sensed in the rinse section of the machine, thereby keeping the machine running until such new time period has elapsed for assuring that the machine will fully complete the washing and rinsing of any food service utensil in the machine while advantageously automatically shutting off the machine soon after it has become empty.

4. The system for conserving energy, water and washing compound in a commercial, electrically energized dishwasher machine, as claimed in claim 3, in which:

said timing means is connected to a pair of available terminals in a multiple terminal control relay which normally serves to energize a conveyor motor in the dishwasher machine for actuating said timing means whenever the conveyor motor is energized.

5. The system for conserving energy, water and washing compound in a commercial, electrically energized dishwasher machine, as claimed in claim 3 or 4, in which:

a key-actuable switch is included in said system, said switch being switchable between first and second positions by the use of an appropriate key, said first position being a manual mode position in which the dishwasher machine is operable in its normal manual control mode without any effect by the system, and said second position being a conservation mode position in which the dishwasher machine is automatically controlled by the system, whereby the dishwasher machine can conveniently be switched by key into its normal manual control mode in the event that maintenance is to be performed on the system or in the event of system malfunction.

6. The system for conserving energy, water and washing compound in a commercial, electrically energized dishwasher machine, as claimed in claim 3 or 4, including:

second pre-settable timing means for being set to a second predetermined time period somewhat less than the time period of the first timing means, warning means controlled by said second timing means for alerting the operator of the dishwasher machine at the expiration of said second time period, said second timing means being started for measuring the second time period whenever the measurement of the first time period is started, thereby providing a warning signal at the end of the second time period for alerting the operator of the washing machine that it will soon be automatically turned off, whereby the operator, if desired, can reload the machine and prolong its operation before it is automatically shut off.

7. The system for conserving energy, water and washing compound in a commercial, electrically energized dishwasher machine, as claimed in claim 3 or 4, in which:

visibly readable elapsed time registering means are connected to said timing means for registering and for indicating the cumulative length of time that the machine has been running.

* * * * *